US007323662B2

(12) United States Patent
Cho et al.

(10) Patent No.: US 7,323,662 B2
(45) Date of Patent: Jan. 29, 2008

(54) HEATING APPARATUS FOR COOKING

(75) Inventors: Pung Yeon Cho, Suwon (KR); Kobayashi Shozo, Suwon (KR); Seok Weon Hong, Yongin (KR); Yun Ic Hwang, Suwon-Si (KR); Yu Jeub Ha, Suwon-Si (KR); Cheol Jin Kim, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/122,051

(22) Filed: May 5, 2005

(65) Prior Publication Data

US 2006/0011607 A1 Jan. 19, 2006

(30) Foreign Application Priority Data

Jul. 16, 2004 (KR) ..... 10-2004-0055530

(51) Int. Cl.
*A21B 1/24* (2006.01)
*A21B 1/26* (2006.01)
*A21B 3/04* (2006.01)

(52) U.S. Cl. ..... 219/401; 219/400; 99/476; 126/20; 126/21 A

(58) Field of Classification Search ..... 219/401
See application file for complete search history.

(56) References Cited

U.S. PATENT DOCUMENTS 2,500,219 A * 3/1950 Troupe ..... 219/401
4,449,026 A 5/1984 Satoh
4,506,598 A * 3/1985 Meister ..... 99/330
5,530,223 A * 6/1996 Culzoni et al. ..... 219/401
5,619,983 A * 4/1997 Smith ..... 126/348
5,768,982 A * 6/1998 Violi et al. ..... 99/476
6,023,050 A * 2/2000 Violi ..... 219/401
6,040,564 A * 3/2000 Ueda et al. ..... 219/682
6,232,587 B1 * 5/2001 Kurita et al. ..... 219/682
6,267,045 B1 * 7/2001 Wiedemann et al. ..... 219/401
6,267,046 B1 * 7/2001 Wanat ..... 99/403
6,318,246 B2 * 11/2001 Fukushima et al. ..... 219/401
6,323,464 B1 * 11/2001 Cohn ..... 219/401

(Continued)

FOREIGN PATENT DOCUMENTS

DE 4420821 12/1995

(Continued)

OTHER PUBLICATIONS

Patent Abstracts of Japan, Application Publication No. 8-178298, Publication Date: Jul. 12, 1996. Abstract Only.

(Continued)

*Primary Examiner*—J. Pelham
(74) *Attorney, Agent, or Firm*—Staas & Halsey LLP

(57) ABSTRACT

A heating apparatus for cooking having a steam-generating device, which is easily cleaned and hygienically used and has improved steam-generating effects. The heating apparatus includes a main body having a cooking chamber; a hot air chamber formed in at least one surface of both side and rear surfaces of the cooking chamber for supplying hot air to the cooking chamber; and a steam-generating device installed in the hot air chamber for supplying steam to the cooking chamber.

23 Claims, 5 Drawing Sheets

U.S. PATENT DOCUMENTS

| | | | | |
|---|---|---|---|---|
| 6,555,791 | B2 * | 4/2003 | Lubrina et al. | 219/400 |
| 6,894,252 | B2 * | 5/2005 | Paller et al. | 219/400 |
| 6,987,246 | B2 * | 1/2006 | Hansen et al. | 219/401 |
| 2006/0054155 | A1 * | 3/2006 | Bujeau et al. | 126/21 A |

FOREIGN PATENT DOCUMENTS

EP 277337 A2 * 12/1987

JP 08178298 A * 7/1996

OTHER PUBLICATIONS

Patent Abstracts of Japan, Application Publication No. 2004-20005, Publication Date: Jan. 22, 2004. Abstract Only.

Patent Abstracts of Japan, Application Publication No. 9-4849, Publication Date: Jan. 10, 1997. Abstract Only.

Korean Patent Abstracts, Application Publication No. 58498, Publication Date: Oct. 5, 2000. Abstract Only.

* cited by examiner

HEATING APPARATUS FOR COOKING

CROSS-REFERENCE TO RELATED APPLICATION

This application claims the benefit of Korean Patent Application No. 2004-55530, filed Jul. 16, 2004, in the Korean Intellectual Property Office, the disclosure of which is incorporated herein by reference.

BACKGROUND OF THE INVENTION

1. Field of the Invention

The present invention relates to a heating apparatus for cooking, and more particularly to a heating apparatus having a steam-generating device for supplying steam to the inside of a cooking chamber.

2. Description of Related Art

Generally, heating apparatuses for cooking include an electronic oven range, an electric oven range, and a gas oven range, for example. The electronic oven range, i.e., a microwave oven, supplies high-frequency waves generated from a magnetron to the inside of a cooking chamber, thereby cooking foods placed in the cooking chamber using heat generated from the foods themselves. The electric oven range or the gas oven range transmits heat, generated from the operation of an electric heater or the combustion of a gas, to the inside of a cooking chamber, thereby cooking foods in the cooking chamber. Since moisture of the foods is evaporated during cooking, the above heating apparatuses for cooking are disadvantageous in that the foods are easily dried. Thus, a steam-generating device for preventing foods from being dried and improving cooking effects is installed in the heating apparatuses for cooking.

EP Patent No. 0277337 discloses a heating apparatus for cooking comprising a steam-generating device having a container shape installed on the bottom of a cooking chamber, and a water tank in a drawer-type installed above the cooking chamber for supplying water to the steam-generating device. Japanese Patent Laid-open No. 2004-20005 discloses a heating apparatus using high-frequency waves comprising an evaporation tray installed on the bottom of a cooking chamber, a heater for heating water in the evaporation tray, and a water tank installed at a side of the cooking chamber for supplying water to the evaporation tray. The above heating apparatuses supply water from the water tank to the steam-generating device or the evaporation tray, heat the water, supplied to the steam-generating device or the evaporation tray, using the heater to generate steam, and then supply the steam to the cooking chamber.

Since the steam-generating devices of the above heating apparatuses for cooking are installed below the cooking chambers, remnants or oil falling from foods placed in the cooking chambers are introduced into the steam-generating devices, thereby contaminating water in the steam-generating devices and causing hygienic problems. Further, it is difficult to separate the steam-generating devices, for repairing, from the main bodies of the heating apparatuses.

Moreover, since the steam-generating devices of the heating apparatuses for cooking are respectively separated from other heat sources, steam is generated only from the steam-generating devices, thereby reducing efficiency in generating steam.

Thus, there is a need for a heating apparatus for cooking, the steam-generating device of which is easily and hygienically cleanable. And, there is need for a heating apparatus for cooking, in which water in a steam-generating device is heated by its peripheral heat as well as its heater, thereby increasing steam-generating effects.

BRIEF SUMMARY

According to an aspect of the present invention, there is provided heating apparatus for cooking including: a main body having a cooking chamber; a hot air chamber for supplying hot air to the cooking chamber; and a steam-generating device in the hot air chamber to supply steam to the cooking chamber.

The hot air chamber may include a heater and an air fan, and the steam-generating device may be heated indirectly by the heater and hot air in the hot air chamber.

The heating apparatus may also include a water supply device for supplying water to the steam-generating device.

The water supply device may include a water tank above the cooking chamber; a water supply pump supplying water from the water tank to the steam-generating device; a plurality of water supply pipes connecting the water tank and the water supply pump and connecting the water supply pump and the steam-generating device.

The steam-generating device may include a water supply pipe receiving water from the water supply device; a heating tank containing the water; a steam-generating heater heating the water contained in the heating tank; and exhaust pipes exhausting generated steam to the inside of the cooking chamber.

The hot air chamber may include a first heater and a second heater, which are separated from each other, and the steam-generating device may be interposed between the first heater and the second heater.

The hot air chamber may further include a first air fan for the first heater and a second air fan for the second heater.

The heating apparatus may also include a hot air chamber cover, provided with a plurality of air vents formed therethrough, detachably attached to the inside of the cooking chamber such that the hot air chamber cover covers the front surface of the hot air chamber.

According to another aspect of the present invention, there is provided a heating apparatus for cooking including: a main body having a cooking chamber; a hot air chamber formed in at least one surface of both side and rear surfaces of the cooking chamber for supplying hot air to the cooking chamber; and a steam-generating device detachably installed in the hot air chamber for supplying steam to the cooking chamber.

The steam-generating device may include a heating tank having a heating container having an opened upper end surface, and a cover member closing the opened upper end surface of the heating container, and the cover member of the heating tank may be fixed to the inside of the hot air chamber, and the heating container of the heating tank may be detachably attached to the cover member.

The cover member may be provided with a steam-generating heater heating water contained in the heating tank, a water supply pipe supplying water to the inside of the heating tank, and exhaust guide pipes for guiding exhaust of steam.

A packing may be placed at an interface between the heating container and the cover member.

A water level sensor sensing a level of the water contained in the heating container may be installed in the cover member.

According to another aspect of the present invention, there is provided a steam supply device for a heating apparatus having a cooking chamber and a hot air chamber supplying hot air to the cooking chamber, including: water tank installed above the cooking chamber; heating tank in the hot air chamber; a water supply pump supplying water in the water tank to the heating tank; and a steam-generating heater in the heating tank converting water contained in the heating tank into steam.

Additional and/or other aspects and advantages of the present invention will be set forth in part in the description which follows and, in part, will be obvious from the description, or may be learned by practice of the invention.

BRIEF DESCRIPTION OF THE DRAWINGS

These and/or other aspects and advantages of the present invention will become apparent and more readily appreciated from the following detailed description, taken in conjunction with the accompanying drawings of which.

DETAILED DESCRIPTION OF EMBODIMENTS

Figure 1:
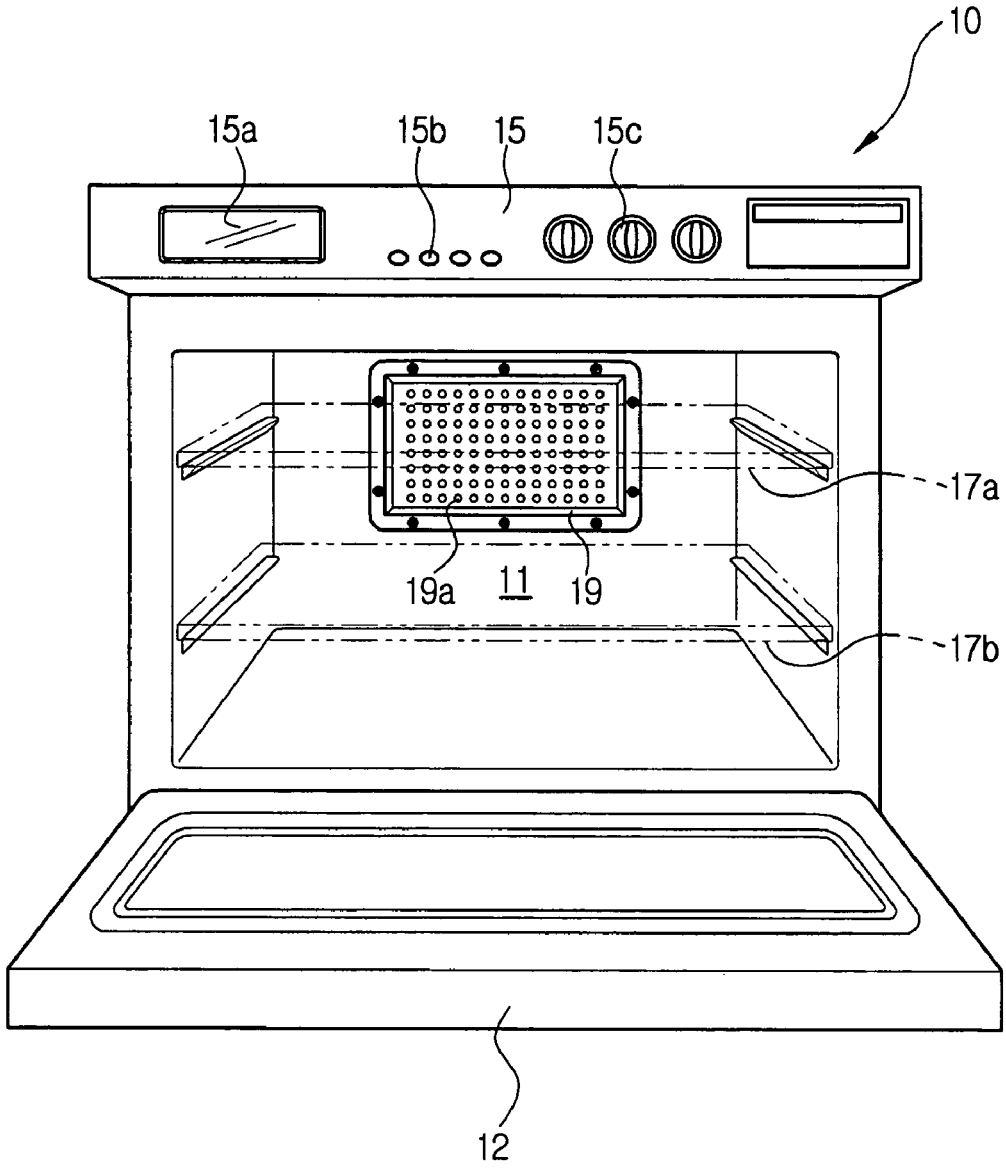
FIG. 1 is a perspective view of a heating apparatus for cooking in accordance with a first embodiment of the present invention.

Reference will now be made in detail to embodiments of the present invention, an example of which is illustrated in the accompanying drawings, wherein like reference numerals refer to like elements throughout. The embodiments are described below to explain the present invention by referring to the figures.

Figure 2:
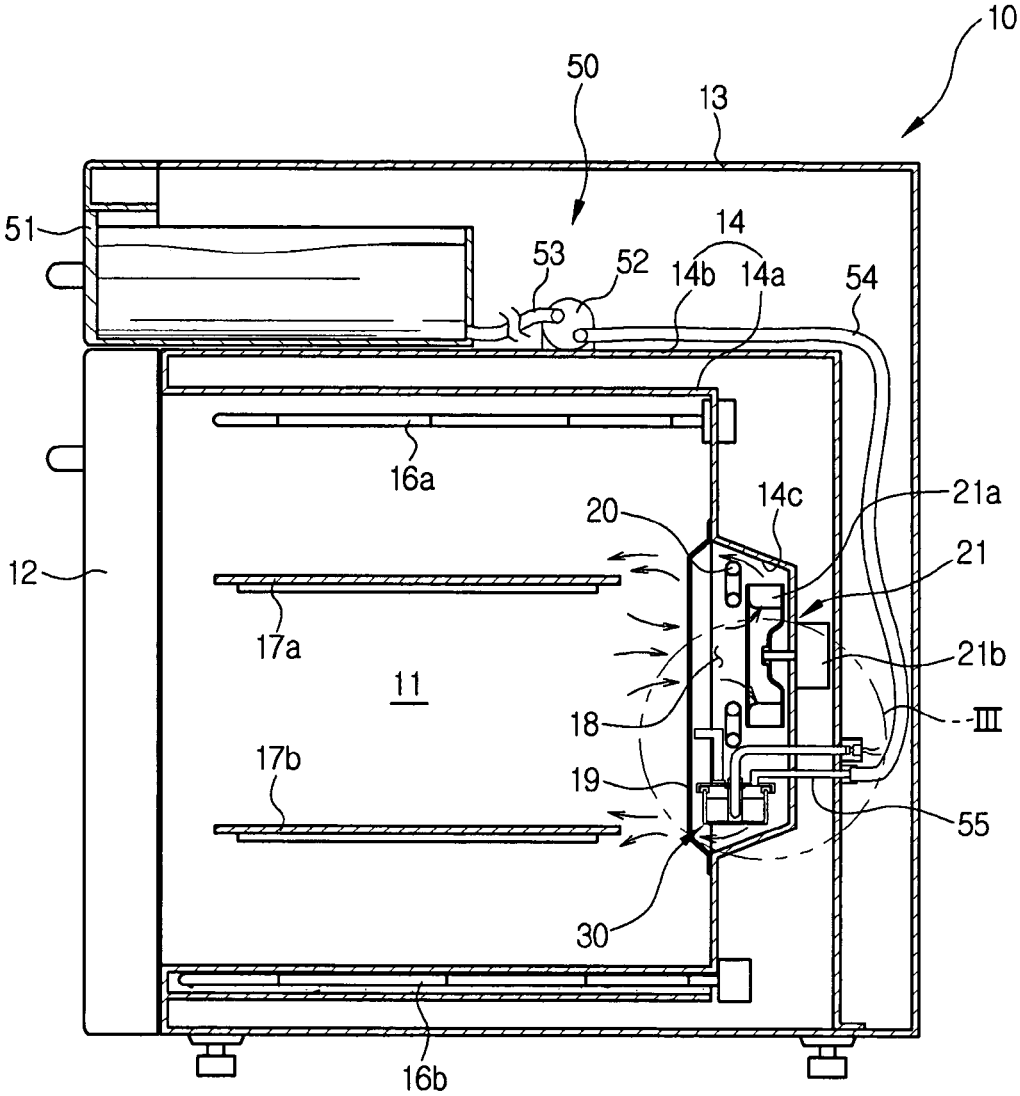
FIG. 2 is a longitudinal-sectional view of the heating apparatus for cooking in accordance with the first embodiment of the present invention.

As shown in FIGS. 1 and 2, a heating apparatus for cooking in accordance with a first embodiment of the present invention includes a main body 10 having a cooking chamber 11 installed therein, and a door 12 vertically rotatably installed on the front surface of the main body 10 for closing the opened front surface of the cooking chamber 11. The heating apparatus for cooking also includes a hot air chamber 18 installed at the rear portion of the inside of the cooking chamber 11, a heater 20 installed in the hot air chamber 18, a blowing device 21 for circulating air in the cooking chamber 11 to the hot air chamber 18, a steam-generating device 30 installed in the hot air chamber 18 for supplying steam to the cooking chamber 11, and a water supply device 50 installed at the upper portion of the cooking chamber 11 for supplying water to the steam-generating device 30.

The main body 10 includes an outer case 13 which may be made of an iron plate, and an inner case 14 installed in the outer case 13 such that the outer surface of the inner case 14 is separated from the inner surface of the outer case 13 for forming the cooking chamber 11. The inner case 14 has a first case 14*a* forming the inner surface of the inner case 14 and a second case 14*b* forming the outer surface of the inner case 14, which are separated from each other. A space is formed between the first case 14*a* and the second case 14*b*, thereby thermally insulating the cooking chamber 11 from the outside. As shown in FIG. 1, an operating unit 15 including a display 15*a* for displaying the operational state of the heating apparatus for cooking, various operating buttons 15*b*, and manipulation switches 15*c* is installed at the upper part of the door 12 on the front surface of the main body 10.

Shelves 17*a* and 17*b* for placing foods thereon are respectively installed at upper and lower portions of the inside of the cooking chamber 11. An upper heater 16*a* and a lower heater 16*b* for heating the foods placed on the shelves 17*a* and 17*b* are respectively installed at the upper and lower portions of the inside of the cooking chamber 11. Here, the upper heater 16*a* is installed at the upper portion of the inside of the cooking chamber 11, and the lower heater 16*b* is installed on the outer lower surface of the cooking chamber 11. That is, the lower heater 16*b* contacts the outer surface of the bottom of the first case 14*a*. The above structure protects the lower heater 16*b* from foreign substances falling from the foods placed in the cooking chamber 11, and transmits heat of the lower heater 16*b* to the inside of the cooking chamber 11 through the bottom of the first case 14*a*.

As shown in FIG. 2, the hot air chamber 18 installed at the rear portion of the inside of the cooking chamber 11 is formed by a depression 14*c* formed in the rear surface of the first case 14*a* by a designated depth. A hot air chamber cover 19, provided with a plurality of air vents 19*a* (in FIG. 1) formed therethrough, is detachably installed on the rear surface of the inside of the cooking chamber 11 such that the hot air chamber cover 19 covers the front surface of the hot air chamber 18. Although the hot air chamber 18 of this embodiment of the present invention is formed at the rear portion of the inside of the cooking chamber 11, the hot air chamber 18 may be formed at both side surfaces of the cooking chamber 11.

The blowing device 21, for circulating air to the hot air chamber 18, includes a centrifugal air blast fan 21*a* installed in the hot air chamber 18, and a driving motor 21*b* installed at the outer surface of the rear portion of the hot air chamber 18 for driving the air blast fan 21*a*. The heater 20 is installed adjacent to the outer periphery of the air blast fan 21*a* in the hot air chamber 18. When the air blast fan 21*a* is operated when the heater 20 is operated, the air in the cooking chamber 11 is inhaled to the air blast fan 21*a*, and is exhausted to the outside of the air blast fan 21*a* in the radial direction of the air blast fan 21*a*. Then, the exhausted air is heated by the heater 20, and is supplied to the inside of the cooking chamber 11. The above circulation of the hot air improves the cooking effects of the foods placed in the cooking chamber 11.

Figure 3:
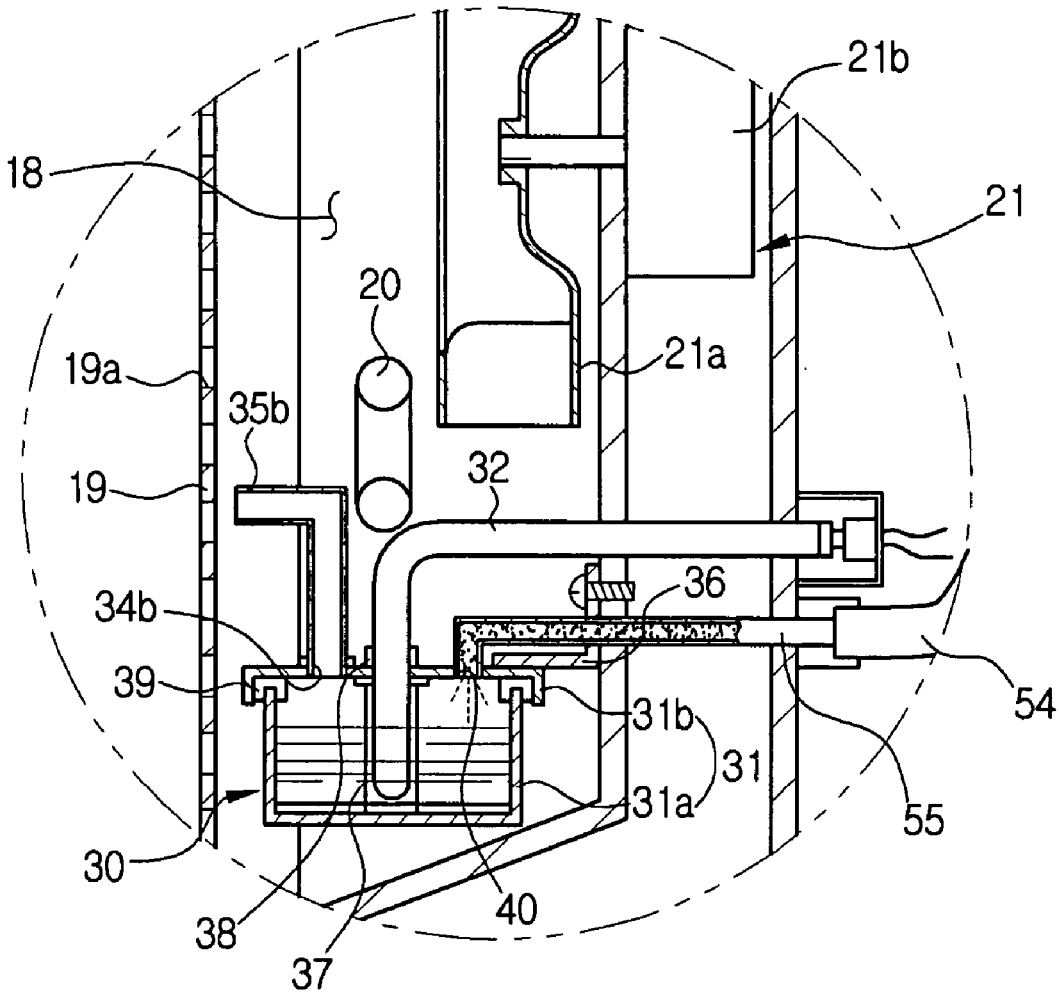
FIG. 3 is an enlarged view of the portion III of FIG. 2.
Figure 4:
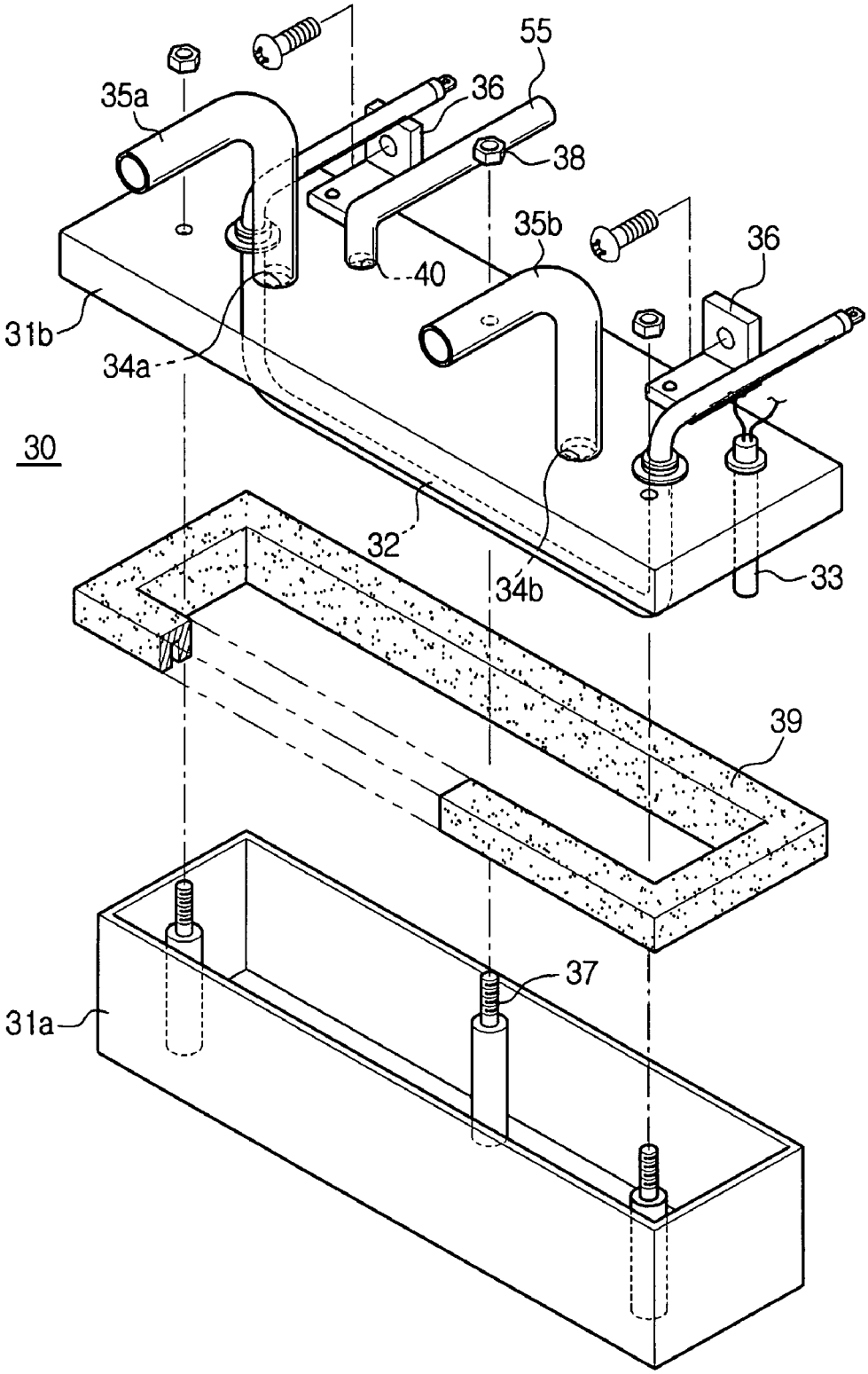
FIG. 4 is an exploded perspective view of a steam-generating device of the heating apparatus for cooking in accordance with the first embodiment of the present invention.

As shown in FIGS. 3 and 4, the steam-generating device in the hot air chamber 18 includes a hermetic heating tank 31 containing a designated quantity of water, a steam-generating heater 32 for heating the water contained in the heating tank 31, and a water level sensor 33 for sensing the level of the water contained in the heating tank 31.

The heating tank 31 includes a heating container 31*a* having a rectangular hexahedral structure provided with an opened upper surface for containing water, and a cover member 31*b* provided with steam exhaust holes 34*a* and 34*b* respectively formed at both sides thereof for closing the opened upper surface of the heating container 31*a*. Here, the cover member 31*b* is fixed to the inner rear surface of the hot air chamber 18 through fixing members 36 installed at upper portions of the rear surfaces of both sides thereof, and the heating container 31*a* is detachably attached to the lower portion of the cover member 31*b*. For this reason, a plurality of fixing bolts 37, which are extended upwardly, are fixed to the inside of the heating container 31*a*. After upper ends of the fixing bolts 37 pass through the cover member 31*b*, fixing nuts 38 are respectively coupled with the corresponding upper ends of the fixing bolts 37, thereby fixing the fixing bolts 37. A packing 39 for maintaining an airtight state is interposed between the upper end of the heating container 31*a* and the cover member 31*b*.

Both ends of the steam-generating heater 32 are fixed to the cover member 31*b* such that the main portion of the steam-generating heater 32 can be soaked in the water in the heating container 31*a*, and an end of the water level sensor 33 is fixed to the cover member 31*b* such that the main portion of the water level sensor 33 can be soaked in the water in the heating container 31*a*. A water supply hole 40 for supplying water to the heating container 31*a* therethrough is formed through the cover member 31*b*, and a water supply pipe 55 of the water supply device 50, which will be described later, is connected to the water supply hole 40. Exhaust guide pipes 35*a* and 35*b* having a designated length for guiding the exhaust of steam are respectively connected to steam exhaust holes 34*a* and 34*b* formed at both sides of the cover member 31*b*.

The steam-generating device 30 generates steam by heating water supplied to the heating tank 31*a* using the steam-generating heater 32, and supplies the steam to the cooking chamber 11 through the exhaust guide pipes 35*a* and 35*b*. Since the steam-generating device 30 is installed in the hot air chamber 18 at the rear of the cooking chamber 11, it is possible to prevent the steam-generating device 30 from being contaminated by remnants or oil falling from the foods. When a user wants to clean the steam-generating device 30, the heating container 31*a* is separated from the cover member 31*b* simply by loosening the fixing nuts 38 installed at the upper portion of the cover member 31*b*, and then the inside of the heating container 31*a* and the outer surface of the steam-generating heater 32 are cleaned.

The above steam-generating device 30 heats the outer surface of the heating tank 31 using the heater 20 in the hot air chamber 18, thereby increasing efficiency in generating the steam, and uniformly supplies the steam exhausted through the exhaust guide pipes 35*a* and 35*b* to the cooking chamber 11 using the air circulating into the hot air chamber 18, thereby improving cooking effects.

As shown in FIGS. 1 and 2, the water supply device 50 placed in the upper portion of the cooking chamber 11 includes a water tank 51 which may be of a drawer-type installed above the cooking chamber 11 so that the water tank 51 can be drawn forward, a water supply pump 52 for supplying water from the water tank 51 to the steam-generating device 30, and a plurality of water supply pipes 53, 54 and 55 for connecting the water tank 51 and the water supply tank 52 and connecting the water supply tank 52 and the heating tank 31. Here, the water supply pipe 53 interposed between the water tank 51 and the water supply pump 52 has a length sufficient to allow the water tank 51 to be drawn forward.

In the above configuration of the water supply device 50, a user can draw the water tank 51 forward from the front surface of the main body 10 and fill the water tank 51 with water, and the water contained in the water tank 51 can be supplied to the heating tank 31 by the operation of the water supply pump 52. Here, the operation of the water supply pump 52 is controlled by the water level sensor 33 installed in the heating tank 31 of the steam-generating device 30 for adjusting the level of the water in the heating tank 31.

Hereinafter, the overall operation of the heating apparatus for cooking and the cleaning method of the steam-generating device of the heating apparatus for cooking will be described in detail.

When foods are placed on either of the shelves 17*a* and 17*b* in the cooking chamber 11 and the heating apparatus for cooking is operated, the upper and lower heaters 16*a* and 16*b* placed at the upper and lower portions of the cooking chamber 11 and the heater 20 placed in the hot air chamber 18 are operated and the air blast fan 21*a* in the hot air chamber 18 is operated. The foods placed in the cooking chamber 11 are heated by heat generated from the upper and lower heaters 16*a* and 16*b* and hot air circulated through the hot air chamber 18 by the operation of the air blast fan 21*a*.

In case that a user wants to cook foods in the cooking chamber 11 using steam supplied to the cooking chamber 11, the user first fills the water tank 51 installed above the cooking chamber 11 with water and then operates the steam-generating device 30. Then, water is supplied from the water tank 51 to the heating tank 31 in the hot air chamber 18 by the operation of the water supply pump 52. Here, a controller (not shown) controls the operation of the water supply pump 52 based on the sensing operation of the water level sensor 33 installed in the heating tank 31, thereby achieving the above water supply. When the level of the water in the heating tank 31 reaches a proper level, the controller supplies power to the steam-generating heater 32 so that the water in the heating tank 31 is heated by the steam-generating heater 32 and is changed to steam. The steam is supplied to the cooking chamber 11 through the exhaust guide pipes 35*a* and 35*b*. The steam exhausted through the exhaust guide pipes 35*a* and 35*b* is uniformly supplied to the inside of the cooking chamber 11 by the air circulating into the hot air chamber 18, thereby preventing the foods from being dried and improving cooking effects.

Here, water in the heating tank 31 of the steam-generating device 30 of the present embodiment is heated by the heater 20 in the hot air chamber 18 as well as the steam-generating heater 32. Accordingly, since the water in the heating tank 31 is rapidly heated and efficiency in generating steam is improved, the steam-generating device 30 employs the steam-generating heater 32 having a low capacity and generates a sufficient quantity of steam. The steam-generating device 30, which employs the steam-generating heater 32 having a low capacity, has low production costs.

On the other hand, when a user wants to clean the inside of the heating tank 31 and the steam-generating heater 32, the user first separates the hot air chamber cover 19 from the rear portion of the cooking chamber 11 and then separates the fixing nuts 38 from the upper surface of the heating tank 31. Thereby, the heating container 31*a* of the heating tank 31 is easily separated from the cover member 31*b*, thus allowing the user to easily clean the inside of the heating tank 31. Further, the separation of the heating container 31*a* from the cover member 31*b* exposes the steam-generating heater 32 fixed to the cover member 31*b* to the outside, thus allowing the user to easily remove foreign substances from the surface of the steam-generating heater 32.

Figure 5:
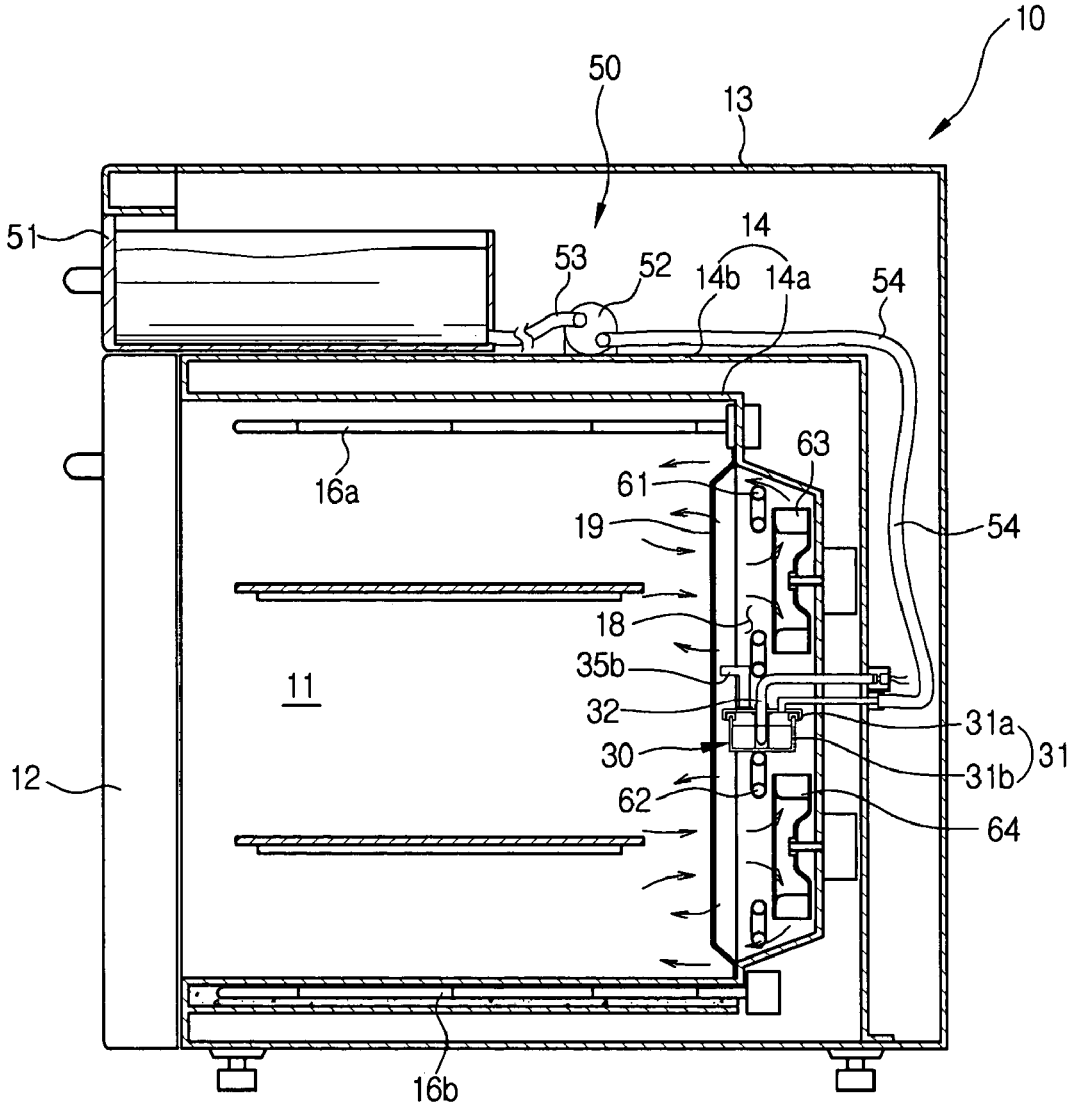
FIG. 5 is a longitudinal-sectional view of a heating apparatus for cooking in accordance with a second embodiment of the present invention.

FIG. 5 illustrates a heating apparatus for cooking in accordance with a second embodiment of the present invention. The heating apparatus for cooking of the second embodiment includes first and second heaters 61 and 62 respectively installed at upper and lower portions of the hot air chamber 18, and first and second air blast fans 63 and 64 respectively installed at the upper and lower portions of the hot air chamber 18. The steam-generating device 30, which is also employed by the heating apparatus of the first embodiment, is interposed between the first heater 61 and the second heater 62. This configuration of the heating apparatus of the second embodiment causes the heating tank 31 of the steam-generating device 30 to be heated by the first and second heaters 61 and 62 as well as the steam-generating heater 32, thereby having improved steam-generating effects compared to the heating apparatus of the first embodiment. The heating apparatus for cooking of the second embodiment, which includes the small-sized heating tank 31 and steam-generating heater 32, generates a sufficient quantity of steam. Other parts of the heating apparatus for cooking of the second embodiment are substantially the same as those of the heating apparatus for cooking of the first embodiment, and detailed descriptions thereof will be thus omitted.

The above-described embodiments of the present invention provide a heating apparatus for cooking having a steam-generating device, which is installed in a hot air chamber in the rear of a cooking chamber, so as to prevent the steam-generating device from being contaminated by remnants or oil falling from foods placed in the cooking chamber, thereby being hygienically used.

Since a heating tank installed in the hot air chamber of the heating apparatus for cooking of the present invention is easily disassembled, the heating tank and the steam-generating heater are easily cleaned.

Since the steam-generating devices of the heating apparatus for cooking of the above-described embodiments of the present invention are installed in the hot air chamber, water contained in the heating tanks is heated by heater(s) in the hot air chamber as well as the steam-generating heater and efficiency in generating steam is improved. Accordingly, the heating apparatuses for cooking employ the steam-generating heater having a low capacity, and generates a sufficient quantity of the steam.

Since the steam, which is exhausted through exhaust guide pipes of the steam-generating device, is uniformly supplied to the cooking chamber by air circulated into the hot air chamber, the heating apparatuses for cooking of the above-described embodiments of the present invention have improved cooking effects.

Although embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A heating apparatus for cooking comprising:

a main body having a cooking chamber;

a hot air chamber in the cooking chamber and supplying hot air to the cooking chamber; and a steam-generating device in the hot air chamber to supply steam to the cooking chamber, wherein the hot air chamber includes a first heater and a second heater separated from the first heater, and the steam-generating device is between the first heater and the second heater, wherein the hot air chamber is located in at least one of a rear surface and side surfaces of the cooking chamber.

2. The heating apparatus according to claim 1, wherein the hot air chamber includes a heater and a fan, and wherein the steam-generating device is heated by the heater and hot air in the hot air chamber.

3. The heating apparatus according to claim 1, further comprising a water supply device supplying water to the steam-generating device.

4. The heating apparatus according to claim 3, wherein the water supply device includes:

a water tank above the cooking chamber;

a water supply pump supplying water from the water tank to the steam-generating device; and a plurality of water supply pipes connecting the water tank to the water supply pump and connecting the water supply pump to the steam-generating device.

5. The heating apparatus according to claim 3, wherein the steam-generating device includes:

a water supply pipe receiving water from the water supply device;

a heating tank containing the received water;

a steam-generating heater heating the contained water; and exhaust pipes exhausting generated steam to the cooking chamber.

6. The heating apparatus according to claim 1, wherein the hot air chamber includes a first fan blowing air heated by the first heater and a second fan blowing air heated by the second heater.

7. The heating apparatus according to claim 1, further comprising a hot air chamber cover having a plurality of air vents formed therethrough and detachably attached to the inside of the cooking chamber such that the hot air chamber cover covers a surface of the hot air chamber.

8. A heating apparatus for cooking comprising:

a main body having a cooking chamber;

a hot air chamber formed in at least one surface of a rear surface and side surfaces of the cooking chamber and supplying hot air to the cooking chamber; and a steam-generating device detachably installed in the hot air chamber supplying steam to the cooking chamber, wherein the steam-generating device includes a heating tank having a heating container having an open upper end surface, and a cover member closing the open upper end surface, and wherein the cover member of the heating tank is fixed to an inside of the hot air chamber, and the heating container of the heating tank is detachably attached to the cover member.

9. The heating apparatus according to claim 8, wherein the cover member has a steam-generating heater heating water contained in the heating tank, a water supply pipe supplying water to the inside of the heating tank, and exhaust pipes exhausting generated steam.

10. The heating apparatus according to claim 8, wherein a packing is placed at an interface between the heating container and the cover member.

11. The heating apparatus according to claim 9, wherein a water level sensor sensing a level of the water contained in the heating container is installed in the cover member.

12. The heating apparatus according to claim 8, further comprising a hot air chamber cover having a plurality of air vents formed therethrough and detachably attached to the inside of the cooking chamber such that the hot air chamber cover covers the front surface of the hot air chamber.

13. The heating apparatus according to claim 9, wherein ends of the steam-generating heater are fixed to the cover member such that a portion of the steam-generating heater is in the contained water.

14. The heating apparatus of claim 9, the exhaust pipes are positioned so as to uniformly supply the exhausted steam to the cooking chamber using the air circulating into the hot air chamber.

15. The heating apparatus according to claim 8, further comprising:

a water supply device including a water tank and a water supply pump supplying water from the water tank to the steam-generating device.

16. The heating apparatus according to claim 15, wherein the water tank is of a drawer-type which is drawable forward.

17. The heating apparatus according to claim 16, wherein a water supply pipe connects the water tank and the water supply pump, the water supply pipe being of sufficient length allow the water tank to be drawn forward.

18. The heating apparatus according to claim 16, wherein the water tank is fillable when drawn forward.

19. The heating apparatus according to claim 15, wherein the water tank is disposed above the cooking chamber.

20. The heating apparatus according to claim 15, wherein operation of the water supply pump is controlled according to a sensed water level sensed by a water level sensor in a heating tank.

21. A heating apparatus for cooking comprising:

a main body having a cooking chamber;

a hot air chamber formed in at least one surface of a rear surface and side surfaces of the cooking chamber and supplying hot air to the cooking chamber; and a steam-generating device detachably installed with reusable fasteners in the hot air chamber supplying steam to the cooking chamber, wherein the steam supply device comprises:

a water tank installed above the cooking chamber;

a heating tank in the hot air chamber;

a water supply pump supplying water in the water tank to the heating tank; and the steam-generating device in the heating tank converting water contained in the heating tank into steam.

22. The heating apparatus according to claim 21, wherein the steam is supplied to the cooking chamber through at least one exhaust pipe.

23. The heating apparatus according to claim 21, wherein water in the heating tank is heated by a heater in the hot air chamber and the steam-generating heater.

* * * * *